United States Patent [19]

Mitchell

[11] 4,399,961

[45] Aug. 23, 1983

[54] TONE BURST RETICLE BEAMRIDER MISSILE GUIDANCE

[75] Inventor: Robert R. Mitchell, Huntsville, Ala.

[73] Assignee: The United States of America as represented by the Secretary of the Army, Washington, D.C.

[21] Appl. No.: 257,687

[22] Filed: Apr. 27, 1981

[51] Int. Cl.[3] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 3,501,113 | 3/1970 | Maclusky | 244/3.13 |
| 3,690,594 | 9/1972 | Menke | 244/3.13 |
| 4,014,482 | 3/1977 | Esker et al. | 244/3.13 |
| 4,186,899 | 2/1980 | Stewart, Jr. | 244/3.13 |
| 4,299,360 | 11/1981 | Layton | 244/3.13 |

FOREIGN PATENT DOCUMENTS

| | | | |
|---|---|---|---|
| 1292509 | 4/1969 | Fed. Rep. of Germany | 244/3.13 |

*Primary Examiner*—Charles T. Jordan

*Attorney, Agent, or Firm*—Nathan Edelberg; Robert P. Gibson; James T. Deaton

[57] ABSTRACT

Apparatus for a beamrider missile guidance system in which a rotating reticle wheel with a predetermined pattern of opaque and transparent segments is used to spatially encode a projected beam of electromagnetic radiation with the projected spatial information being used as a tone burst code with the frequency of the tone being proportional to missile position and the projected information being projected in two axes with appropriate timing of the burst for axis recognition.

3 Claims, 6 Drawing Figures

TONE BURST RETICLE BEAMRIDER MISSILE GUIDANCE

DEDICATORY CLAUSE

The invention disclosed herein may be manufactured, used, and licensed by or for the Government for governmental purposes without the payment to me of any royalties thereon.

BACKGROUND OF THE INVENTION

Beamrider missile systems utilize a form of line of sight missile guidance in which a beam of spatially encoded electromagnetic radiation is projected in the direction of a target and a rearward-looking missile-borne receiver decodes the spatial information and thereby determines the missile's position within the beam. The missile corrects its position as necessary to remain at or near the beam center until target impact.

Among previously known forms of beamrider spatial encoding, some are not suitable for use at longer wavelengths where atmospheric transmission is better, where use of a single radiation source is more desirable for cost and size reasons, and where diffraction limits the beam resolution attainable. Of those which are suitable for use at longer wavelengths, all have one or more other disadvantages such as requiring a more technically difficult pulsed source, requiring more complex decoding electronics on the missile, and requiring complex optical and/or mechanical parts in the projector, requiring maintenance at a prelaunch synchronized clock phase on the missile during flight, and failing to provide any means of encoding rate bias for moving targets. Therefore, it can be seen that there is a need for a beamrider missile system that can overcome disadvantages of other devices.

In view of the need, it is an object of this invention to provide a tone burst reticle beamrider missile guidance system that overcomes disadvantages of prior devices.

Another object of this invention is to provide a tone burst reticle beamrider missile system which utilizes a reticle with optically transparent and opaque surfaces thereon and so arranged to allow two tone bursts to be projected toward a missile receiver for guidance of the missile.

Still another object of this invention is to provide a tone burst reticle beamrider missile system in which the reticle thereof produces tone bursts that are asymmetrically spaced in time.

Other objects and advantages of this invention will be obvious to those skilled in this art.

SUMMARY OF THE INVENTION

In accordance with this invention, a tone burst reticle beamrider missile guidance system is provided in which a continuous wave laser output beam is chopped by reticle means to provide a two tone burst output that is asymmetrically spaced in time and projected to the receiver of a missile for guiding the missile to a predetermined target. The reticle means of the system for producing the asymmetric output includes a single disc for producing the desired output or a pair of discs that are rotated by a common rotating means with the discs being mounted parallel to each other with segments of each disc overlapping.

DESCRIPTION OF THE PREFERRED EMBODIMENT

Figure 2:
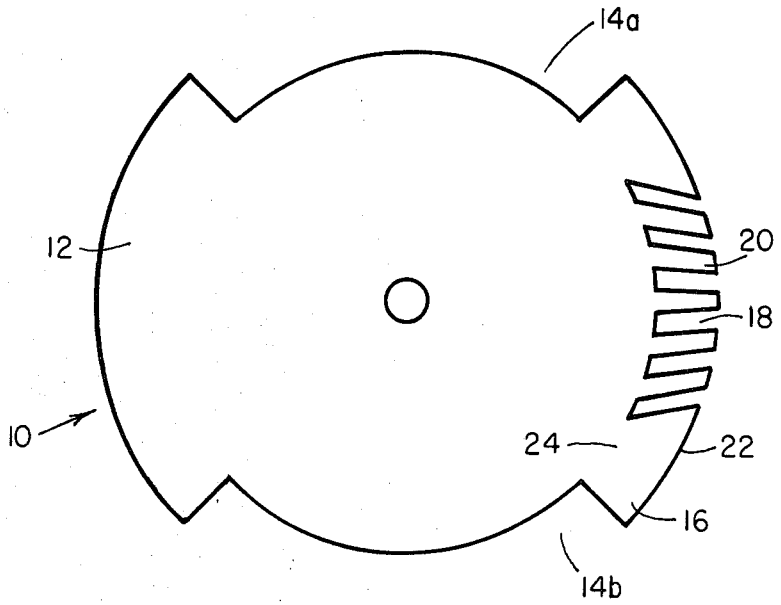
FIG. 2 is a view illustrating structure of a reticle disc utilized in the system of this invention.

Referring now to the drawing, FIG. 2 illustrates a reticle wheel or disc 10 in accordance with this invention with the reticle wheel being at the heart of the invention. Reticle wheel 10 includes an opaque segment 12, two transparent segments 14*a* and 14*b* and a chopping segment 16 having a plurality of alternate transparent and opaque sections 18 and 20 respectively. Transparent sections 18 each have a width at the outer circumference 22 of disc 10 that is half that of the width at inner circumference 24. That is, transparent sections 18 each taper outwardly from circumference 24 to circumference 22. The alternate transparent and opaque sections of 18 and 20 are spaced relative to each other generally as illustrated. In practice, it has been found that an arcuate section with an outer circumferential width of about 3 degrees for transparent section 18 and an inner circumferential width at 24 of about 6 degrees for transparent section 18 works well.

Figure 1:
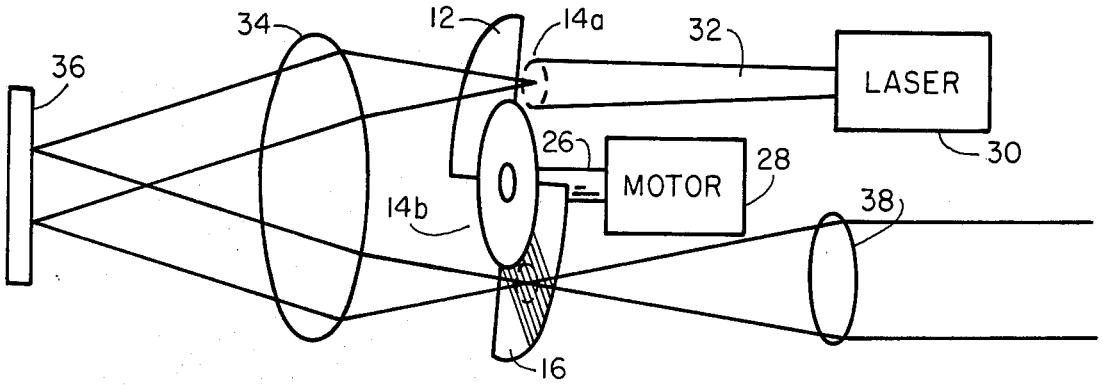
FIG. 1 is a schematic illustration of a tone burst reticle beamrider missile guidance system in accordance with this invention.
Figure 3:
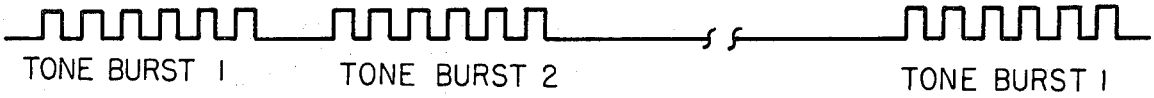
FIG. 3 is a graphic illustration of the two different tone bursts that are asymmetrically spaced in time as illustrated.

Referrng now to FIG. 1, reticle wheel 10 is mounted at its axis of rotation to shaft 26 in a conventional manner with shaft 26 being driven by a conventional variable speed motor 28. A continuous wave laser source 30 such as a carbon dioxide laser produces a laser output beam 32 that is passed through transparent section 14*a* of disc 10 as illustrated and then to lens 34 and from lens 34 to mirror 36 that reflects the beam back through lens 34 to chopping section 16 of reticle wheel 10 to chop the beam and image the chopped beam transmitted from reticle wheel 10 to lens 38 which is of a fixed or variable focal length and which projects the images from reticle wheel 10 in sustantially parallel rays and in the direction in which it is desired to fly a missile. As reticle wheel 10 continues to rotate, chopping section 16 chops the laser beam 32 prior to its transmission to lens 34 and mirror 36 which reflects the transmitted laser beam back through lens 34 and transparent section 14*b* of reticle wheel 10 to pass this transmitted and chopped portion of beam 32 as an inverted and reverted image that is presented to lens 38 that images the beam in the direction of the missile that is to be guided thereby. Also, as reticle wheel 10 is rotated, laser beam 32 from source 30 is chopped as previously described by alternate opaque-transparent section 16 and transparent sections 14*a* and 14*b*. The chopping segments of section 16 are arranged so that locations within the field of beam 32 are at different radii from the axis of reticle wheel 10 and are chopped at different frequencies. Thus, with tone burst frequency discrimination processing, reticle position can be determined. In this example of FIG. 1, the chopping frequency at the outer edge of the field is twice that at the inner edge. The frequency at any intermediate location between the inner and outer edge is linearly proportional to radial position, thus providing a linear transfer function for missile position. The slight curvature of the guidance field caused by the circular path of chopping segments 20 do not significantly affect accuracy. It is also pointed out that since the chopping locations of reticle wheel 10 are approximately 90 degrees apart when the reticle wheel chops the laser energy from laser beam 32, the chopping axes are orthogonal as required. When chopping sections 20 of segment 16 are crossing either reticle position located approximately 90 degrees apart, the reticle is transparent at the other location. During the remaining part of each rotation as represented by segment 12, the reticle is opaque at this approximately 90 degree position and blocks transmission of the laser beam so that no radiation is transmitted during this time. With this arrangement, there are two tone bursts being projected through lens 38 to the receiver, one for the up-right to down-left axis and the other for the up-left to down-right axis. The tone bursts are asymmetrically spaced in time, as illustrated in FIG. 3, so that the receiver on the missile desired to be guided can with simple logic thereon determine which burst is which. In this manner, this device can be used to guide a missile to a target.

Figure 4:
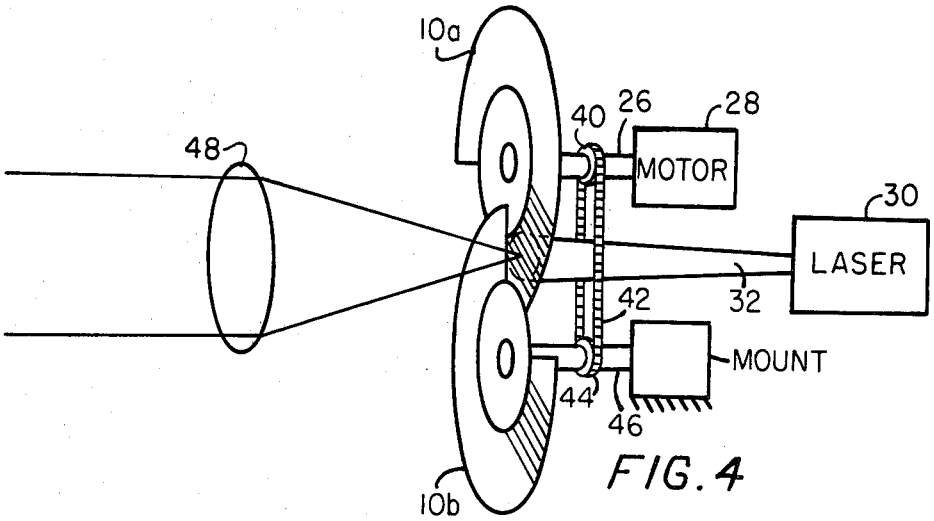
FIG. 4 is another embodiment of a tone burst reticle beamrider missile guidance system in accordance with this invention.
Figure 5:
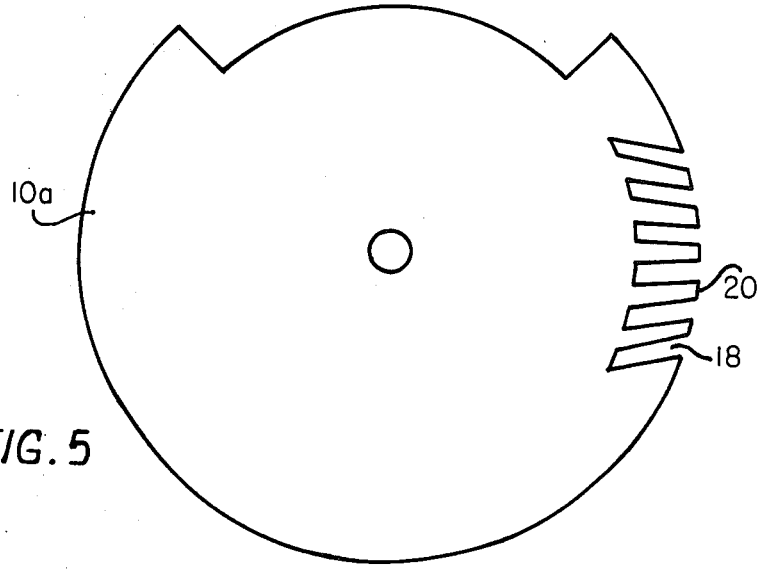
FIG. 5 is a view illustrating the structure of the reticle disc utilized in the embodiment of FIG. 4.

Referring now to FIG. 4, another embodiment of this invention is illustrated and includes a conventional variable speed motor 28 that drives through shaft 26 to rotate reticle discs 10*a* and 10*b*. Reticle disc 10*a* is directly connected in a conventional manner to shaft 26 and a chain pulley 40 on shaft 26 drives through chain 42 and chain drive pulley 44 which is mounted on shaft 46 which is rotatably mounted in a conventional manner and with one end connected to reticle disc 10*b*. As illustrated, motor 28 drives discs 10*a* and 10*b* simultaneously at the same rate of speed. Reticle disc 10*a* is illustrated in FIG. 5 and includes an approximately 90 degree chopping segment and an approximately 90 degree transparent section with the remainder of the reticle disc being opaque to the laser energy. Reticle discs 10*a* and 10*b* are identical, however one of the discs is turned over 180 degrees so that the chopping segments and the opaque segments are opposite to each other to allow first and second tone bursts to be produced in substantially the same manner with the structure illustrated in FIG. 3 as that described for FIG. 1. Laser 30 is of the same type as that of FIG. 1 and produces a laser output beam 32 that is chopped by reticle wheels 10*a* and 10*b* to produce tone bursts one and two repeatedly as illustrated in FIG. 3 with the beam being projected to and through lens 48 which projects the image in substantially parallel rays in the direction in which it is desired to direct a missile. In this embodiment, when the chopping segments of either reticle are crossing the beam of radiation 32, the other reticle wheel presents its transparent section. During the remaning part of each rotation of reticle wheels 10*a* and 10*b*, one or both of the reticle wheels are opaque so that no radiation is transmitted.

Figure 6:
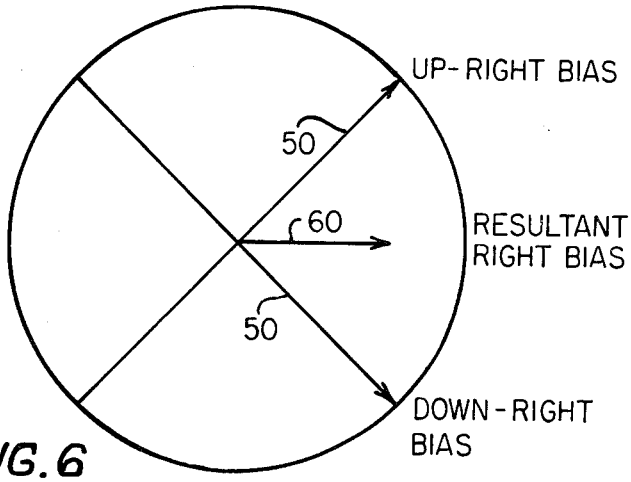
FIG. 6 is a schematic illustration of the biases transmitted with the result being produced from the received signals.

In either embodiment of FIGS. 1 or 4, simply speeding up or slowing down of motor 28 causes a shift in sensed position in both axes. That is, as illustrated in FIG. 6, control axes 50 are so arranged that this results in a bias in horizontal guidance plane 60 which is commonly required for engaging moving targets.

What is claimed is:

1. A tone burst reticle beamrider missile guidance system comprising reticle wheel means mounted for rotation at a substantially constant rate and having chopping section means, transparent section means, and opaque section means, a laser source mounted relative to said reticle wheel means and illuminating said reticle wheel means, and lens means for receiving chopped signals from said reticle wheel means and being adapted for projecting the chopped reticle wheel means signals in the direction of a missile, said chopping section means and said transparent section means being located on said reticle wheel means so as to allow first and second tone bursts to be produced and substantially orthogonically spaced, said reticle wheel means being a single wheel that has four segments that are arranged about the circumference of the reticle wheel as a first and transparent section, a second and chopping section with alternate opaque and transparent segments, a third and transparent section and a fourth and opaque section, said first, second, third and fourth sections being said chopping section means, said transparent section means and said opaque section means.

2. A tone burst reticle beamrider missile guidance system as set forth in claim 1, wherein said reticle wheel means is connected to a variable speed motor and said lens means including a first lens having a first portion for receiving illumination from said laser source, a mirror mounted for receiving illumination from said first lens and reflecting said illumination through a second portion of said first lens and through one of said four segments to a second lens mounted on an opposite side of said single wheel and being adapted for projecting said first and second tone bursts.

3. A tone burst reticle beamrider missile guidance system comprising reticle wheel means mounted for rotation at a substantially constant rate and having chopping section means, transparent section means, and opaque section means, a laser source mounted relative to said reticle wheel means and illuminating said reticle wheel means, and lens means for receiving chopped signals from said reticle wheel means and being adapted for projecting the chopped reticle wheel means signals in the direction of a missile, said chopping section means and said transparent section means being located on said reticle wheel means so as to allow first and second tone bursts to be produced and substantially orthogonically spaced, said reticle wheel means including first and second reticle wheels that are mounted parallel to each other and with overlapping segments, said first and second reticle wheels each having a transparent section, a chopping section with alternate opaque and transparent segments and an opaque section about a circumferential portion of the remainder of each wheel, said first and second wheels being driven by a common drive means so that said transparent section of said first wheel overlaps said chopping section of said second wheel once during each revolution of motion of said first and second reticle wheels.

* * * * *